United States Patent [19]

Frank et al.

[11] Patent Number: 5,054,947

[45] Date of Patent: Oct. 8, 1991

[54] SELF-CONTAINED POWER PAINTING SYSTEMS

[75] Inventors: Peter L. Frank, Corcoran; Terry R. Reents, Burnsville, both of Minn.

[73] Assignee: Wagner Spray Tech Corp., Minneapolis, Minn.

[21] Appl. No.: 393,698

[22] Filed: Aug. 11, 1989

Related U.S. Application Data

[63] Continuation-in-part of Ser. No. 260,523, Oct. 21, 1988, abandoned.

[51] Int. Cl.[5] ..... B05C 17/03; A46B 11/02

[52] U.S. Cl. ..... 401/146; 401/149; 401/150; 401/188 R; 401/288; 401/290

[58] Field of Search ..... 401/146, 149, 188, 288, 401/289, 290, 150, 188 R, 187; 15/22 R, 29; 200/81 H

[56] References Cited

U.S. PATENT DOCUMENTS

| | | | |
|---|---|---|---|
| 1,577,192 | 3/1926 | Rapisardi . | |
| 2,206,208 | 7/1940 | Thomas . | |
| 2,227,792 | 1/1941 | Morton, Jr. | 401/290 X |
| 2,504,487 | 4/1950 | Anson . | |
| 2,825,080 | 3/1958 | Bongiovanni | 401/288 |
| 3,195,170 | 7/1955 | Howard . | |
| 3,278,975 | 10/1966 | Nakaya et al. . | |
| 3,304,573 | 2/1967 | Stefely | 401/187 |
| 3,418,054 | 12/1968 | Kirch | 401/188 |
| 3,943,591 | 3/1976 | Lanusse . | |
| 4,250,586 | 2/1981 | Timian . | |
| 4,540,301 | 9/1985 | Swanson et al. . | |
| 4,639,156 | 1/1987 | Stern et al. . | |
| 4,647,738 | 3/1987 | Diamond . | |
| 4,790,679 | 12/1988 | Murphy | 401/146 |

FOREIGN PATENT DOCUMENTS

| | | | |
|---|---|---|---|
| 2567729 | 1/1986 | France | 401/188 R |
| 63-1675 | 7/1988 | Japan . | |
| 63-1676 | 7/1988 | Japan . | |
| 63-1677 | 7/1988 | Japan . | |
| 63-168077 | 11/1988 | Japan . | |
| 76212363 | 3/1988 | Taiwan . | |
| 351443 | 7/1931 | United Kingdom . | |
| 363312 | 12/1931 | United Kingdom | 401/188 |
| 1296033 | 11/1972 | United Kingdom | 200/81 H |
| 1321670 | 6/1973 | United Kingdom | 401/290 |
| 2096888 | 10/1982 | United Kingdom . | |
| 2097007 | 10/1982 | United Kingdom | 401/188 R |

OTHER PUBLICATIONS

Asahipen American brochure The Portable Painting Machine.

*Primary Examiner*—Steven A. Bratlie

*Attorney, Agent, or Firm*—Hill, Van Santen, Steadman & Simpson

[57] ABSTRACT

A self-contained power painting system is provided in which a battery operated motor and pump are contained in a lid for a paint reservoir, and that entire unit is adapted to be carried on a user by a strap or belt. A paint applicator, such as a brush or roller, is connected to the pump by a flexible conduit and includes a switch activator at the applicator to permit the user to selectively control operation of the pump and to move about freely while painting without being emcumbered by a relatively immobile paint reservoir or power source connection through extension cords.

20 Claims, 9 Drawing Sheets

SELF-CONTAINED POWER PAINTING SYSTEMS

CROSS-REFERENCE TO RELATED APPLICATION

This application is a continuation-in-part of U.S. application Ser. No. 07/260,523 filed Oct. 21, 1988 now abandoned.

BACKGROUND OF THE INVENTION

The present invention relates to painting equipment and more particularly to powered paint applicators.

Paint is commonly applied to a surface to be covered by means of brushes, rollers, pads or other similar applicators which, in a non powered application mode require the periodic dipping of the applicator into a reservoir of paint to load the applicator with a fresh supply of paint.

Powered applicators have been developed to avoid the constant reloading of the applicator so that the painting can occur in a more or less continuous fashion. In such powered applicators, there generally is a motor driven pump which supplies the paint to the applicator via a conduit and switch means are provided, generally at the applicator, to control the flow of paint to the applicator.

In most instances, a large reservoir of paint, for example a one gallon paint can or its equivalent, is situated in a relatively stationary position and a pump and motor are provided in a housing adjacent to or within the same housing as the paint reservoir. A long flexible conduit extends between the stationary pump and reservoir to the applicator so that the person applying the paint can move within a certain area to apply the paint continuously before the pump and reservoir must be moved to a new location.

Generally such an arrangement is satisfactory where large surface areas such as walls or ceilings are being painted in that a significant amount of time is required to paint an area encompassed by the length of the flexible conduit. Thus, movement of the pump and reservoir occurs infrequently.

However, in some painting situations, such as the painting of trim, only a small surface area is being covered in any location thus requiring more frequent movement from one location to the next, requiring frequent movement of the reservoir and pump. Furthermore, even when painting large areas, the stoppage of paint application to move the pump and reservoir presents a cumbersome and time-consuming task. Therefore, it would be an improvement to the art if there were provided a powered paint applicator which did not require the frequent stopping of the painting application to move the pump and reservoir to a new location.

SUMMARY OF THE INVENTION

The present invention provides a powered paint applicator which does not require stopping of the painting application to move from location to location in that the pump and reservoir are compact and portable and can be carried by the user. If the type of painting application is one which requires frequent movement between distant locations, such as trim painting or touch ups, the volume of paint required is reduced considerably over painting applications such as walls or ceiling where relatively large amounts of paint are applied at one location. If the type of painting application is one which requires larger volumes of paint, such as painting walls or ceilings, the configuration as well as the size of the pump and reservoir become significant considerations. Having recognized the problems associated with each type of painting application, the Applicants have been able to reduce the volume of the reservoir and also the size of the pump, and to configure a reduced-sized pump with a reservoir, so as to result in a compact and readily portable unit that can be easily carried by the user and which contains a sufficient volume of paint to permit painting for a reasonable amount of time between refills of the reservoir. The applicator, which in one preferred embodiment is illustrated as a bristled brush and in another preferred embodiment as a roller, is connected to the pump and reservoir housing by a pair of conduits, a first of which supplies paint from the pump to the brush, and the second of which may be air filled and used in connection with a pneumatic switch in the pump housing, activated by a bulb at the brush to selectively energize a motor carried in the pump housing to operate the pump and cause paint to flow from the reservoir to the brush. Since the reservoir, pump and applicator are all to be carried by the user, the length of conduit from the pump housing to the applicator can be reduced considerably over that required for relatively stationary pump and reservoir housings in that the applicator will always be within no more than four to five feet from the reservoir. Further, since the reservoir is carried by the user at an elevation above floor level where it normally is in the case of a relatively stationary pump and reservoir housing, the head, or vertical distance that the pump is required to move paint is considerably reduced. These two factors permit a much smaller pump and motor to be utilized than is necessary in relatively stationary units.

Because of the reduced size required for the pump and motor, an alternative power source, such as batteries, can be utilized to power the motor thus making the entire assembly portable and not requiring the use of an external power source.

The entire pump housing and reservoir can be easily carried by the user by means of a strap or a belt. The paint reservoir can be easily accessed through a removable cover providing a relatively large opening into the top of the reservoir. The cover can include the entirety of the pump, motor and power supply and can have a separate access thereto for replacing or repairing component parts. The pump housing extends downwardly into the reservoir to enhance compactness and provide extra protection for the pump and motor.

In one preferred embodiment, the pump is a peristaltic pump in which a plurality of rollers engage a collapsible tube to draw paint through the tube. Paint is drawn up from the reservoir through a suction tube which is connected to the collapsible tube, which in turn is connected to the flexible conduit leading to the applicator. Thus, paint is maintained within a tube or conduit from the time it leaves the reservoir until it is discharged into the applicator thereby making clean up of the apparatus very simple and reducing the number of components contacted by the paint. Within the pump housing itself, paint is located inside the flexible tubing.

In another preferred embodiment, the pump is a small piston pump. The pump components may be formed from plastic, thus providing a strong, light-weight, and inexpensive mechanism.

In a preferred embodiment for use with relatively large reservoirs, a pump, batteries, and an electric motor are in a common housing. The top of the housing is roughly coplanar with, and sealed to, a top edge of the reservoir. This arrangement not only enhances compactness, but also serves to further protect the pump and motor by providing a double enclosure.

In order to accommodate the need for different types of applicators, the invention provides for easily interchangeable applicator heads.

Other advantages of the present invention will become apparent upon reference to the accompanying description, when taken in conjunction with the following drawings.

DESCRIPTION OF THE PREFERRED EMBODIMENTS

Figure 1:
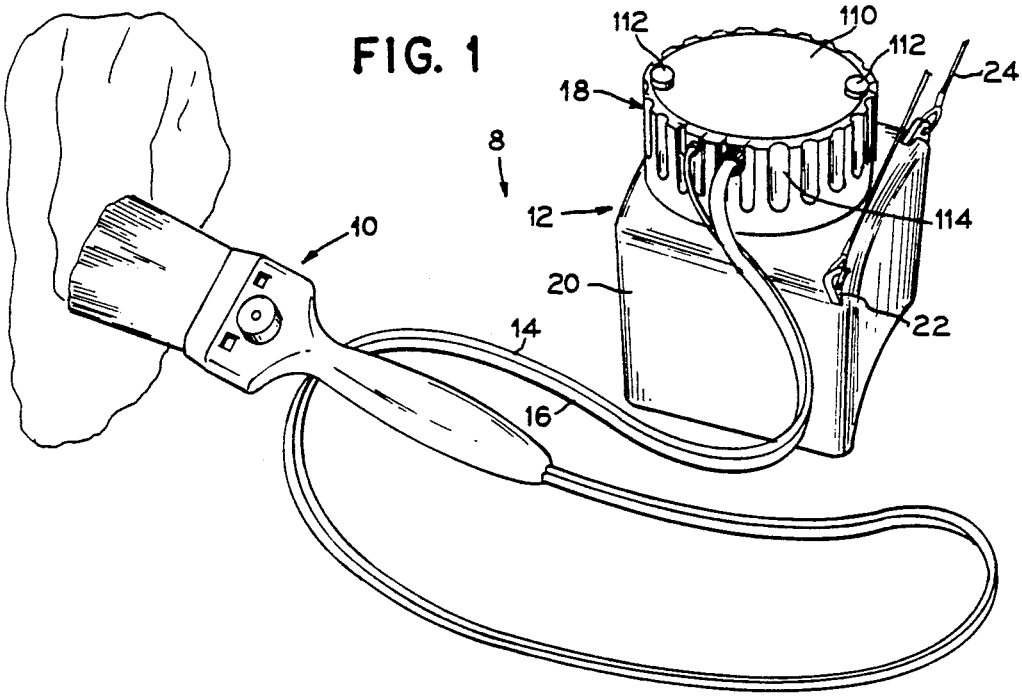
FIG. 1 is a perspective view of a pump housing and reservoir and paint applicator incorporating the principles of the present invention.

In FIG. 1 there is illustrated a power paint system 8 embodying the principles of the present invention which includes an applicator 10, a reservoir and pump housing unit 12 and a pair of connecting conduits 14, 16. The applicator 10, in this preferred embodiment, is illustrated as bristled brush, but it may also be a foam pad, a roller, or other similar type of applicator. For example, see U.S. Pat. No. 4,611,941 assigned to the assignee of this application, which is incorporated herein by reference and which illustrates several types of applicators known to those skilled in the art.

The pump housing and reservoir unit 12 consists of a removable cover portion 18 and a depending paint reservoir portion 20. The cover portion 18 incorporates within it a pump, motor and power source, which will be described below, and maintains those components separate from the paint stored in the reservoir 20.

The reservoir 20, which is a walled container with an open top closed by the cover portion 18, may be supplied with a pair of protruding ears 22 to which can be attached a strap 24 so that the pump and reservoir housing unit 12 can be easily carried by the user. The protruding ears 22 could alternatively be attached to the cover portion 18, or the housing unit 12 could also be carried by means of a belt or other fastening arrangement so as to make the housing unit 12 portable with the user without requiring the user to hold the housing unit 12 with his hands.

Figure 3:
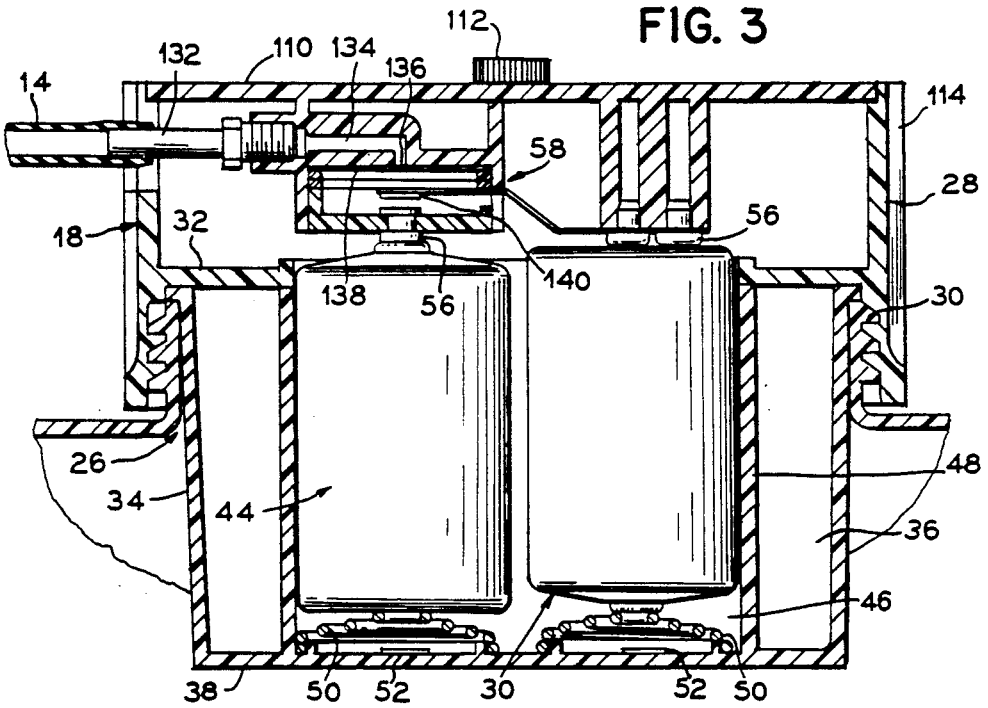
FIG. 3 is a side sectional view of the battery compartment and switch contacts taken generally along the line III—III of FIG. 2.
Figure 4:
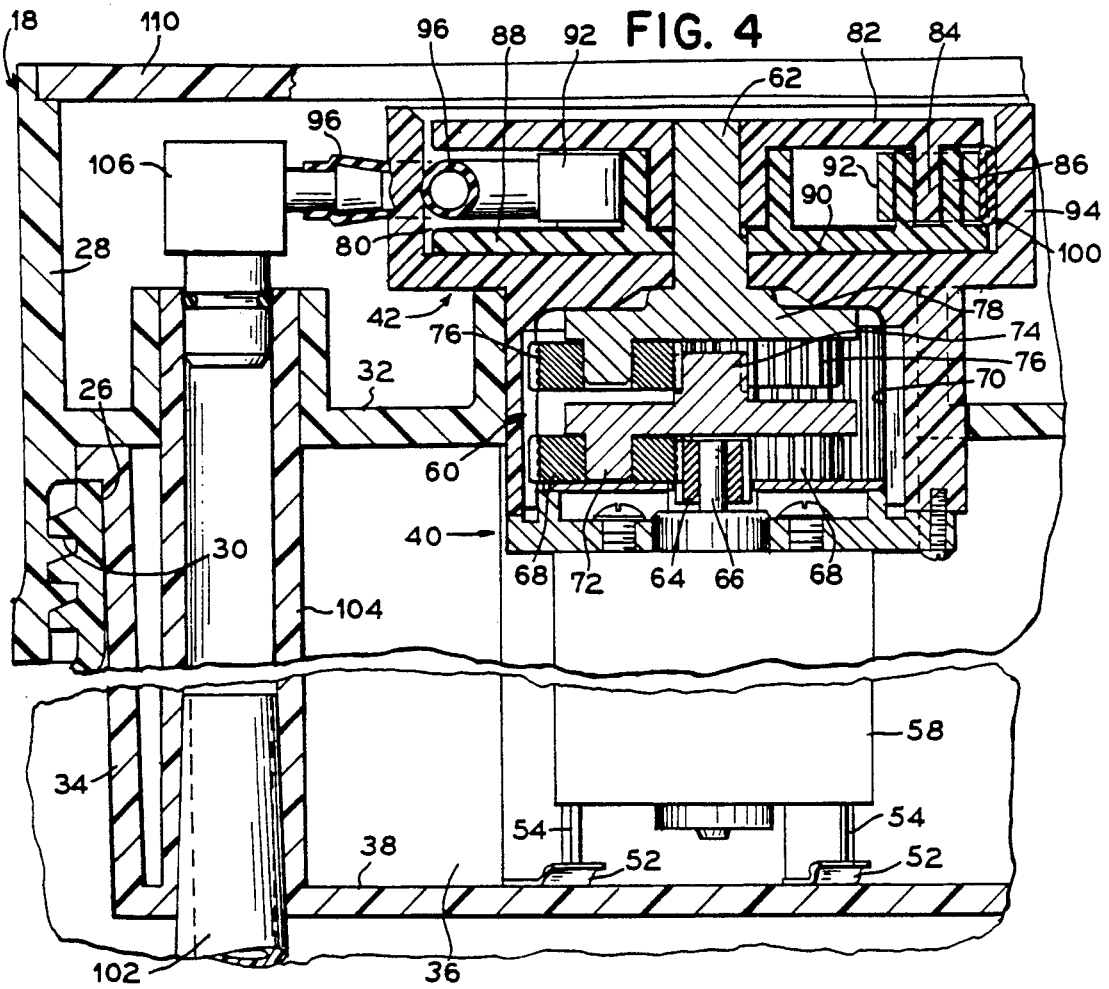
FIG. 4 is a side sectional view of the motor and pump taken generally along the line IV—IV of FIG. 2.

As seen in FIGS. 3–4, the cover portion 18 for the reservoir 20 covers a top opening 26 in the reservoir. The housing unit 18 has a cylindrical outer wall 28 which is shown as being held on the paint reservoir 20 by a threaded engagement 30 but could be alternatively secured by other known arrangements, such as a bayonet fastener. A floor 32 is formed on the interior of the housing unit 18 and a smaller diameter cylindrical wall 34 depends downwardly from the floor 32 to form a chamber 36 which extends into the paint reservoir 20. The chamber 36 is bounded at a lower end by a floor 38. The cover portion 18 encloses a motor 40, a pump 42 and a power source 44.

The power source 44, preferably, is a pair of D sized cell batteries which, if desired, can be of the rechargeable type. The batteries 44 are positioned in a power supply chamber 46 which is formed in the lower chamber 36 and are separated from the remainder of the chamber by an oval enclosing wall 48. The batteries 44 each contact a compressible coil spring 50 at their lower ends, which springs in turn contact metal strips 52 which contact electrical terminals 54 on the motor 40. A top end of the batteries 44 contact electrical terminals 56 which have a switch 58 interposed therebetween. Operation of the switch is described in detail below.

The motor 40 is a gear reducer motor which includes a small DC motor 58 supported on the floor 38 of the depending chamber 36 which drives a double planetary gear set 60 to reduce the rotational speed of an output shaft 36.

The gear set 60 is comprised of a first sun gear 64 which is carried on an output shaft 66 of the motor 58 which engages and rotates a plurality, preferably three, of planet gears 68 which engage at an outer periphery a ring gear 70. The planet gears 68 are carried on a spider 72 which has a second sun gear 74 formed thereon which engages and rotates a second set of planet gears 76 which also engage the stationary ring gear 70. A second spider 78 carries the second planet gears 76 and includes the upstanding output shaft 62.

Figure 2:
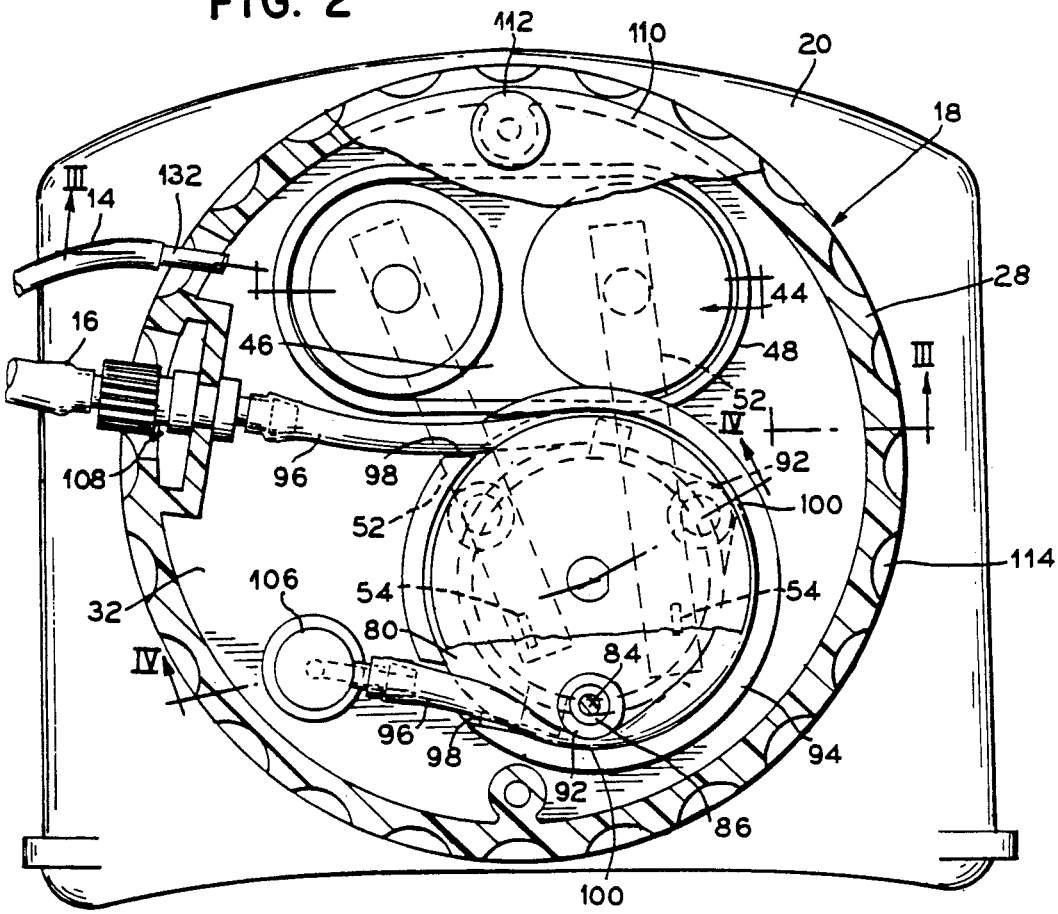
FIG. 2 is a top view of the pump housing and reservoir, partially cut away to show the interior thereof.

The output shaft 62 extends into a pumping chamber 80 which is elevated above the floor 32 and is keyed to a disk 82 having a plurality of downwardly depending fingers 84, shown in FIG. 2 to be three such fingers. The three fingers are received in upstanding cylindrical receptacles 86 of a second disk 88 such that the two disks are rotated with the output shaft 62. The second disk 88 slidingly rides on a floor 90 of the pumping chamber 80 in an upper portion of the pump housing 18. Carried around the outside of each of the upstanding cylindrical receptacles 86 is a roller 92. The fingers 84, cylinders 86 and rollers 92 are positioned such that the roller 92 is situated closely adjacent to an upstanding outer wall 94 of the pumping chamber 80. A collapsible tube 96 has a central segment positioned in the pumping chamber 80 between the two disks 82, 88. The tube 96 extends at both ends out of the pumping chamber 80 through openings 98 in the upstanding wall 94. In the location of the rollers 92, the distance between the roller 92 and the upstanding wall 94 is less than the normal diameter of the flexible tubing 96, and thus the tubing is squeezed nearly flat between the rollers 92 and wall 94 as shown in FIGS. 2 and 4 at 100.

As viewed in FIG. 2, the disks 82, 88 and thus rollers 92 are rotated in a counter-clockwise direction and, since the flexible tubing 97 extends more than 180° around the circumference of the pumping chamber 80, it is assured that two rollers 92 will be in pinching engagement with the tubing 96 at any given time. As the disks and rollers rotate, the action causes paint to be drawn into the flexible tubing 96 from the reservoir 20, first through a suction tube 102 depending from the floor 38 of the depending chamber 36, a connecting conduit 104 formed in the pump housing unit 18 and through a connector fitting 106 to the flexible tubing 96. The paint is then urged outwardly through a coupling unit 108 to the flexible conduit 16 which is connected to the applicator 10. Thus, the paint flowing through the pumping chamber 80 is always confined within the flexible tubing 96 and is not in contact with any of the moving parts of the pump.

The interior of the pump housing 18 is easily accessed by removal of a cover plate 110 which is shown as being held on by a pair of thumb screws 112, but could in the alternative be secured by slot-type screws or other known fasteners. Removal of the cover plate 110 provides access to the batteries 44 as well as the connections for the flexible tubing 96 and the entire pump and motor assembly. To assist in the attachment of the pump housing 18, the outer circumferential wall 28 of the housing has a plurality of spaced recesses 114 to act as finger grips to assist in the rotation of the pump housing 18 relative to the reservoir 20. The connection of the pump housing 18 to the reservoir 20 could also be by means other than a threaded connection such as a bayonet lock, a snap fit or other similar connections which would provide a liquid tight seal.

Figure 5:
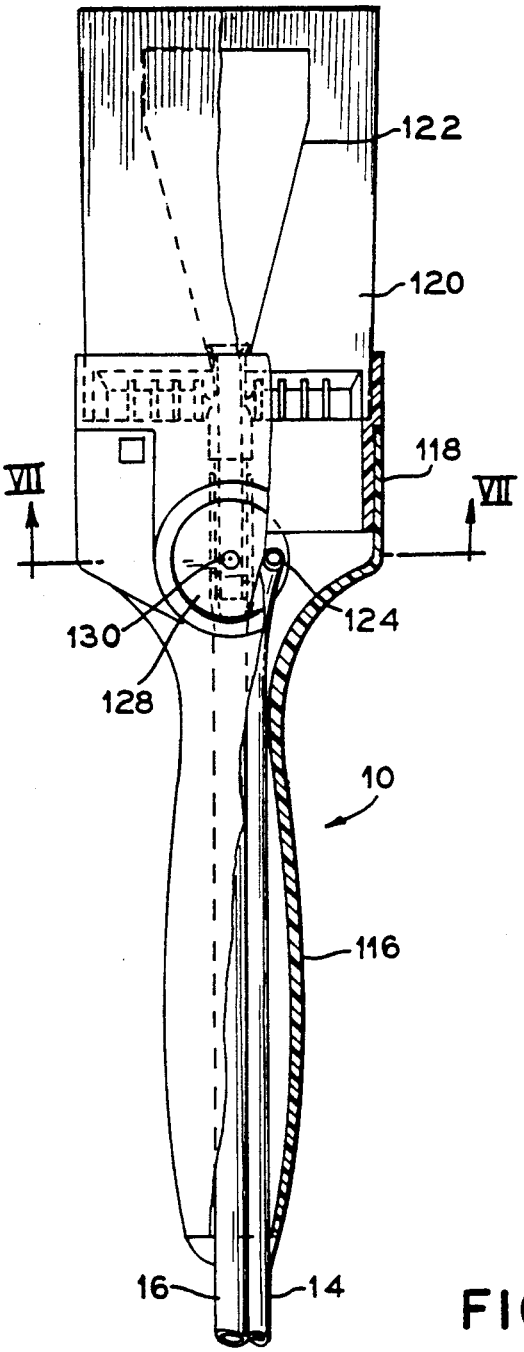
FIG. 5 is an elevational view, partially cut away, of the paint applicator.
Figure 6:
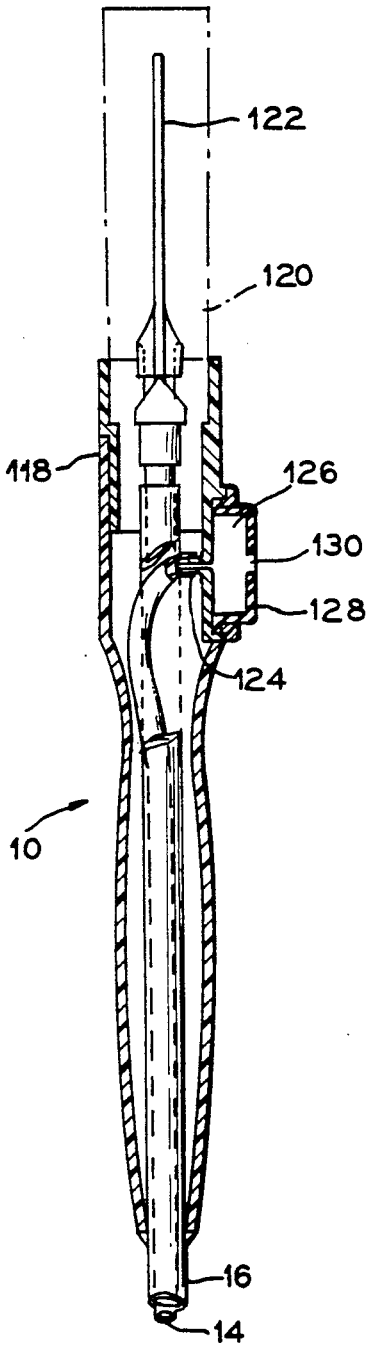
FIG. 6 is a side sectional view of the paint applicator.
Figure 7:
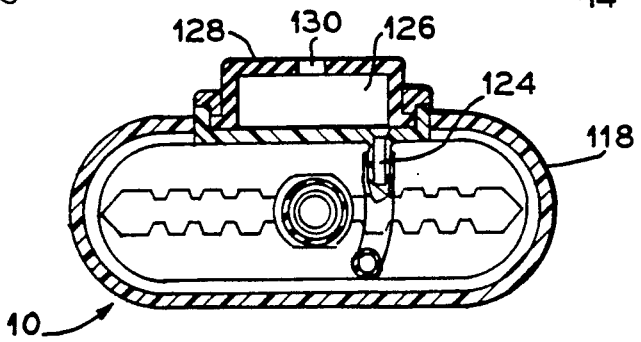
FIG. 7 is a sectional view of the paint applicator taken generally along the line VII—VII of FIG. 5.

FIGS. 5, 6 and 7 illustrate the applicator 10 which, as described above, is shown as a bristled brush. The brush has a manually graspable handle 116 with a head portion 118 and a plurality of paint applying bristles 120 projecting therefrom. The handle and head are hollow and carried within the handle are the flexible conduits 14, 16 which enter through an end of the handle 116 and proceed toward the head 118. The conduit 16 carrying the paint extends beyond the head 118 and is connected to a fan shaped spreader 122 which distributes the paint over a wide area within the bristles as is known in such brush constructions.

The conduit 14 is connected in the head 118 to an opening 124 leading to a chamber 126 covered by a bulb 128 having an aperture 130 therein. Referring back to FIG. 3, the air conduit 14 is attached to the pump housing 18 by means of a connector 132 which communicates with a passage 134 formed in a depending portion of the removable cover 110. The passage 134 communicates with a top surface 136 of a flexible diaphragm 138 which is movable toward and away from a movable contact 140 of the switch 58 which, in turn, is movable toward and away from a fixed switch contact 142.

When a user places a thumb or finger over the aperture 130 in the bulb 128, the volume of air within the conduit 14 and chamber 126 is fixed. Then, when the user presses down on the bulb to collapse the volume of the chamber 126, the result is that the diaphragm 138 is displaced toward the movable contact 140 and, in fact, deflects the movable contact 140 toward and against the fixed contact 142 to complete an electrical circuit through the batteries 44 and to the motor 58. This causes the motor to become energized and to rotate the disks 82, 88 and rollers 92 to cause paint to be pumped.

When the thumb or finger pressure is released or the opening 130 is uncovered, the diaphragm will move away from the movable contact 140 thus breaking the circuit and deenergizing the motor. Therefore, pumping action occurs only when selected by the user and, through the use of pneumatic switch, there is no possibility of shorting the electrical circuit due to leakage of paint since there are no electrical contacts at the applicator and the contacts that are in the pump housing are separated and isolated from any possible paint contamination.

By having an apertured bulb, the pneumatic switch is not affected by changes in atmospheric pressure changes or other such conditions, and therefore is responsive only to specific calls for paint by the user when the user specifically covers and presses the bulb 128.

Figure 8:
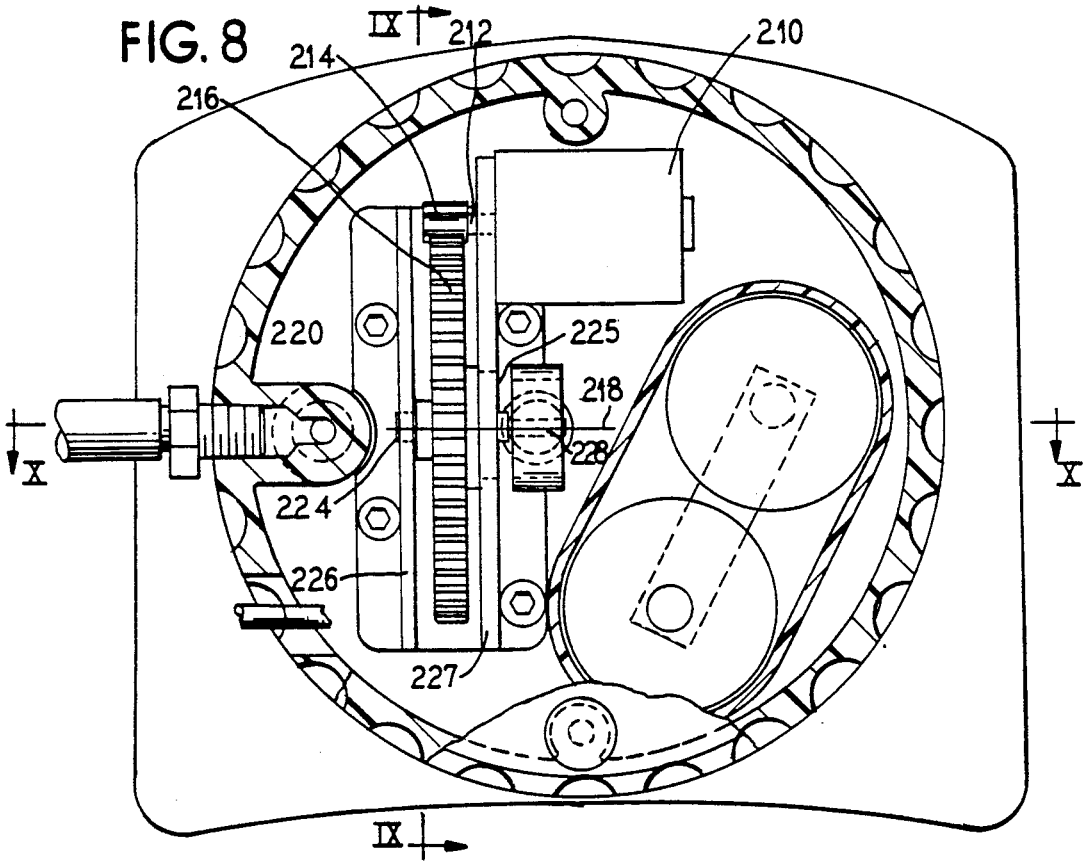
FIG. 8 is a top view, partially broken away, of a second embodiment of the present invention.
Figure 9:
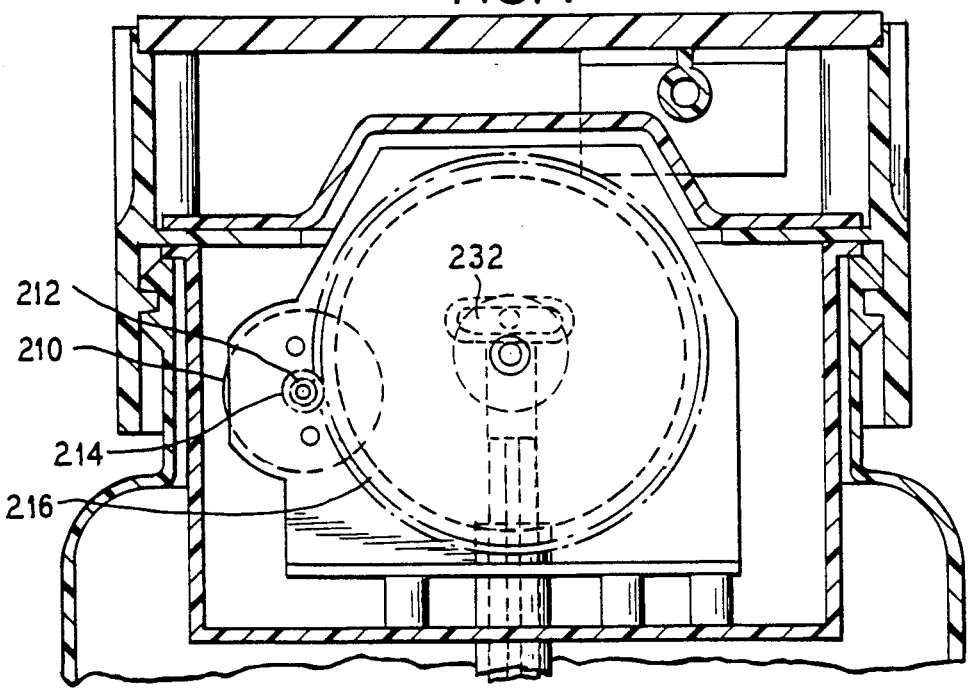
FIG. 9 is a sectional view taken along lines IX—IX of FIG. 8.
Figure 10:
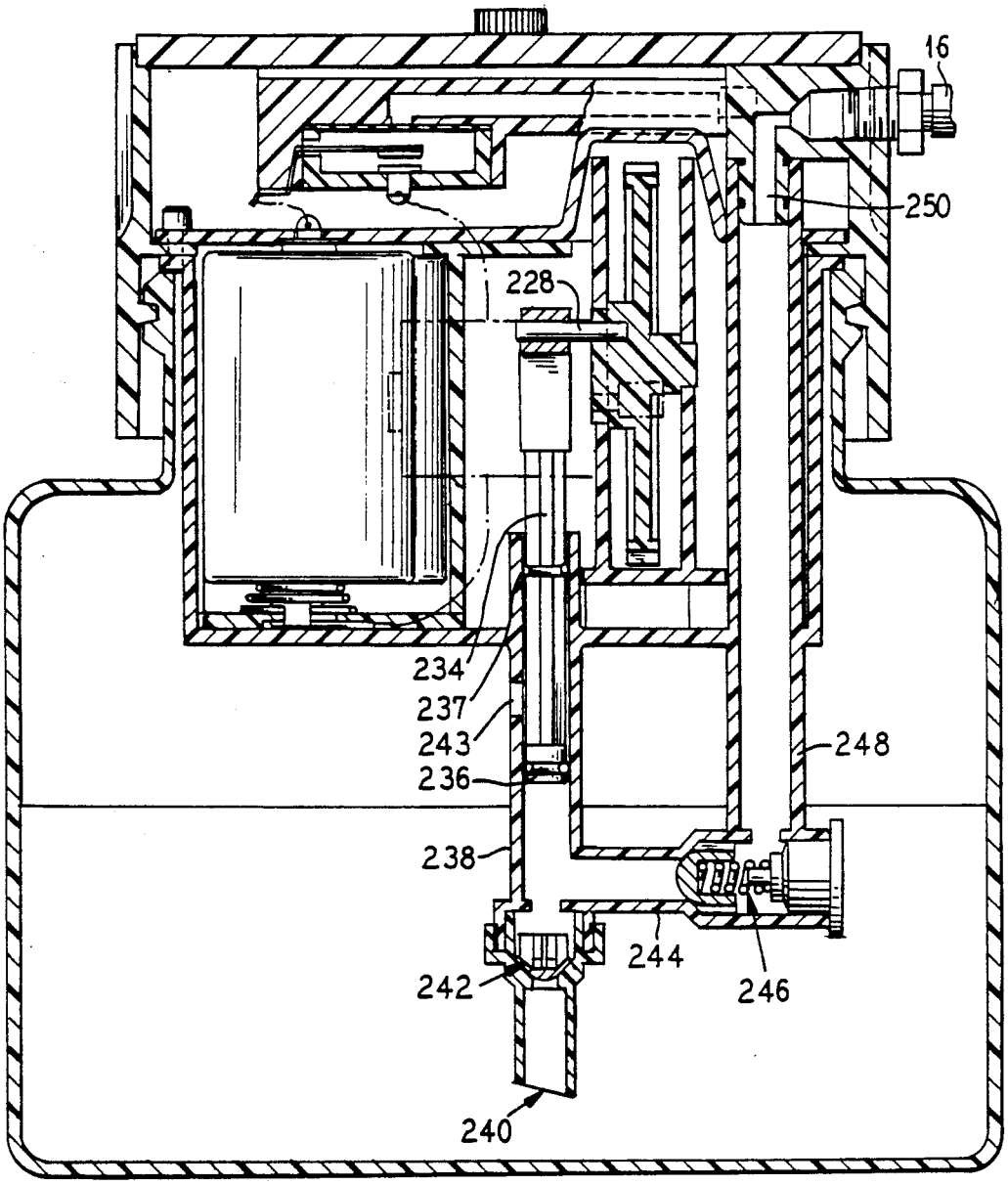
FIG. 10 is a sectional view taken along lines X—X of FIG. 8, with the position of the motor and drive gear shown in broken line.
Figure 11:
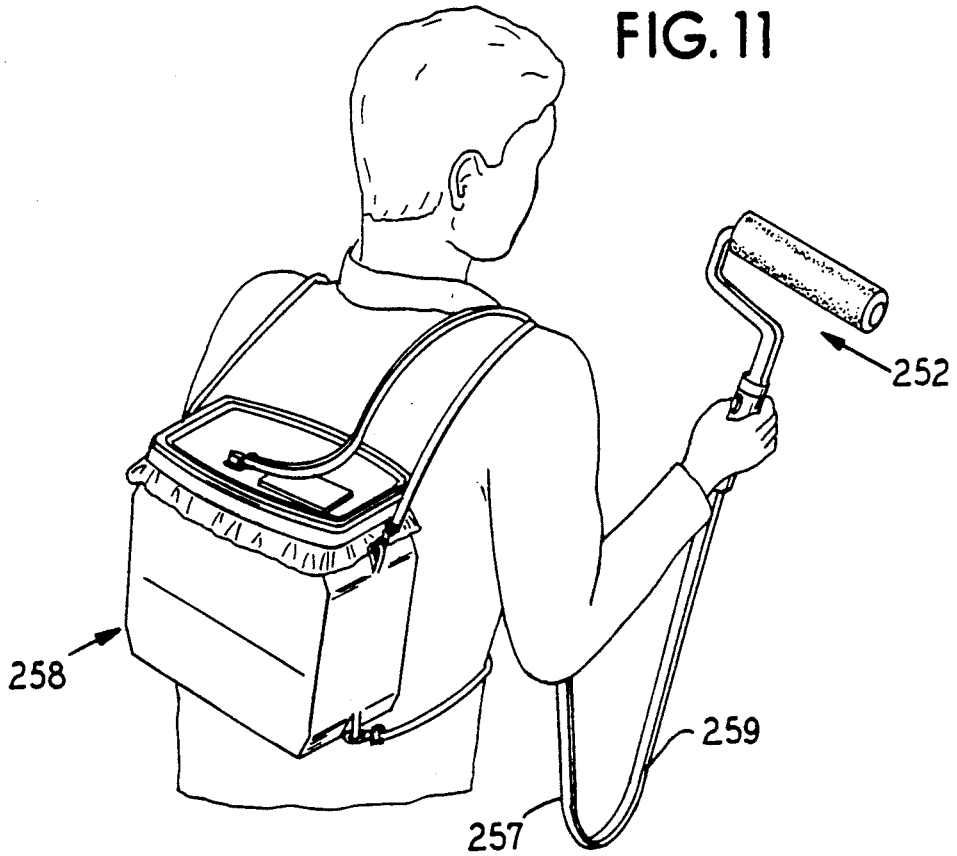
FIG. 11 is a view of yet another embodiment of the present invention in operation.
Figure 13:
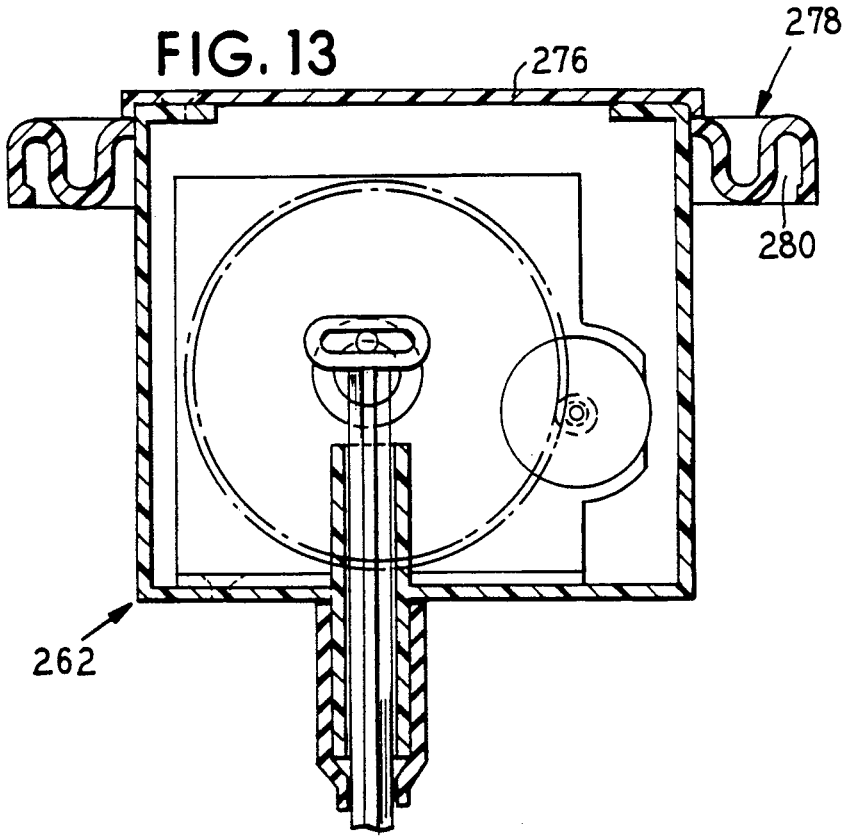
FIG. 13 is a partial sectional view of a pump mechanism of the FIG. 11 embodiment.

With reference to FIGS. 8–10, another embodiment of the present invention is shown which differs from the embodiment of FIGS. 2 and 4 only in the details of its pump and motor. In this further embodiment, a motor 210 rotates a drive shaft 212 to which is affixed a drive gear 214. The drive gear 214 engages and drives a gear wheel 216, which is supported for rotation about an axis 218 via a cylindrical hub assembly 220. The cylindrical hub assembly is rotatably secured by a bearing assembly 222 that supports each end 224, 225 of the hub assembly 220 with a bearing flange 226, 227. An eccentric shaft 228 extends from the end 225 of the hub assembly 220 and is received in a horizontal slot 232 at a first end of a piston shaft 234. The piston shaft 234, at a second end, supports a piston 236, with an intermediate seal ring 237 interposed between the first and second ends of the piston shaft. The piston and intermediate ring are mounted in a piston tube 238 which leads to a suction inlet 240 normally closed by a check valve 242. The piston tube 238 is provided with at least one drain opening 243, which allows any paint that may leak past the piston 236 to be returned to the reservoir 20. A connecting tube 244 leads from the suction inlet 240, through a second check valve 246, to an output tube 248, which in turn leads to an outlet passage 250 connected to the conduit 16 which feeds the applicator 10.

In operation, when the switch 58 is actuated, the motor 210 rotates the drive gear 214, which in turn rotates the gear wheel 216. Rotation of the gear wheel 216 causes the rotation of the eccentric shaft 228.

The horizontal component of rotational movement of the eccentric shaft 228 is accommodated by lateral movement in the horizontal slot 232, while the vertical component of rotational movement causes the reciprocation of the piston shaft 234, hence the reciprocation of the piston 236. On the upstroke, piston 236 creates a partial vacuum in the piston tube 238, which opens the check valve 242, closes the check valve 246, and causes paint to enter the suction inlet 240 and fill the piston tube 238. On the downstroke, the piston 236 pressurizes the paint in the piston tube 238, which closes the check valve 242, opens the check valve 246, and causes the paint to flow through the output tube 248, the outlet passage 250, and the conduit 16 to the applicator 10.

FIGS. 11–16 show yet another embodiment of the present invention, intended for painting applications in which larger volumes of paint are required. The embodiment shown is provided with a piston pump, and the operation and actuation of the device is similar to the embodiments previously described.

A roller applicator 252 has an actuator bulb 254 mounted on a handle 256. Extending from the handle 256 are conduits 257, 259 leading to a reservoir and pump housing unit 258, which consists of a reservoir 260 and a housing 262. The reservoir 260 includes a bottom 264 from which extends a retaining wall 266 ending in a top edge 268. The reservoir 260 may also be provided with a liner 270 to aid in clean-up after painting. The housing 262 includes a bottom wall 272, at least one sidewall 274, and a top wall 276. Around the housing, near the top wall 276, extends an S-shaped perimeter 278, which includes a downwardly opening channel 280 for receiving the top edge 268 of the reservoir 260.

Figure 12:
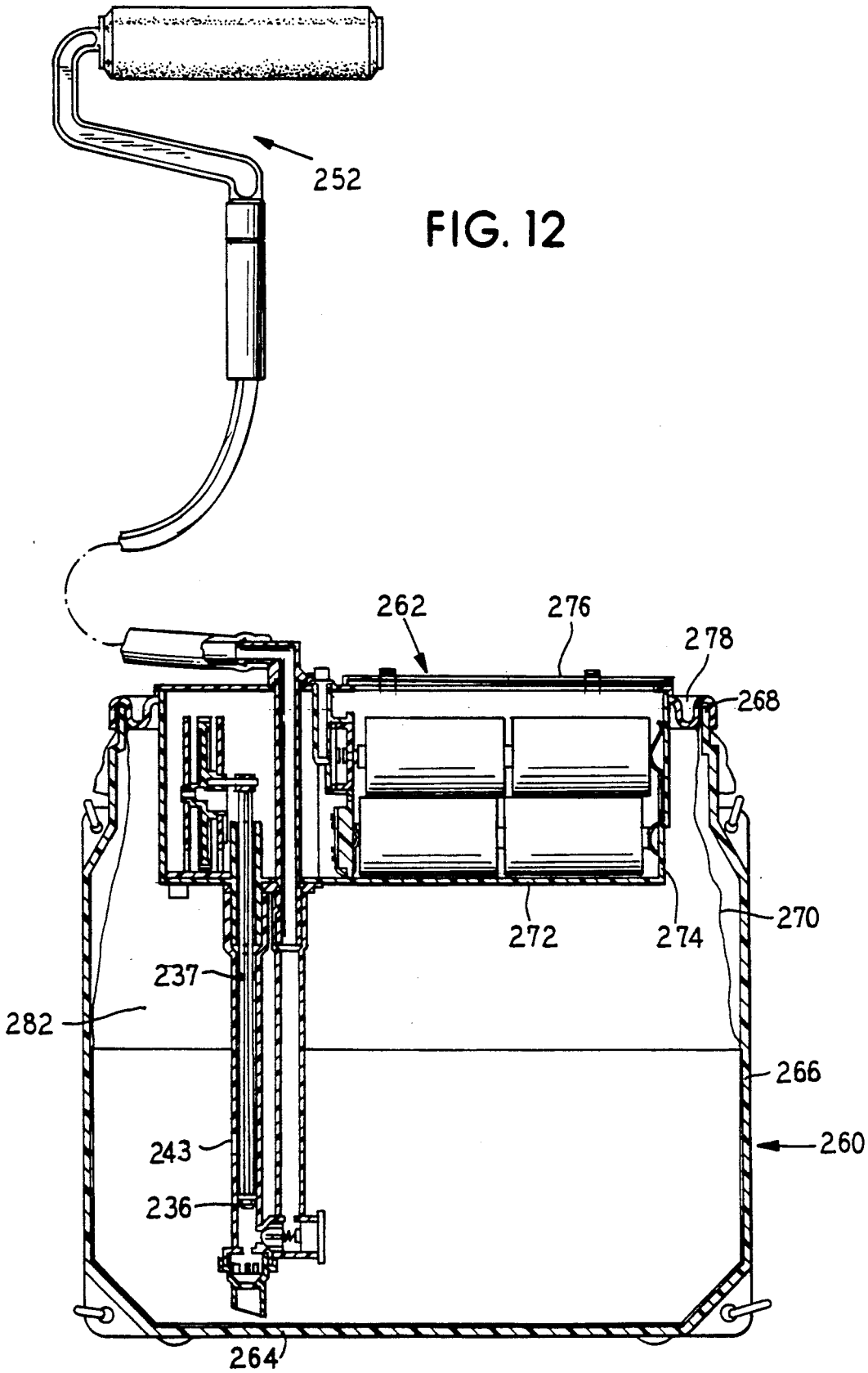
FIG. 12 is a sectional view of the embodiment of FIG. 11.
Figure 14:
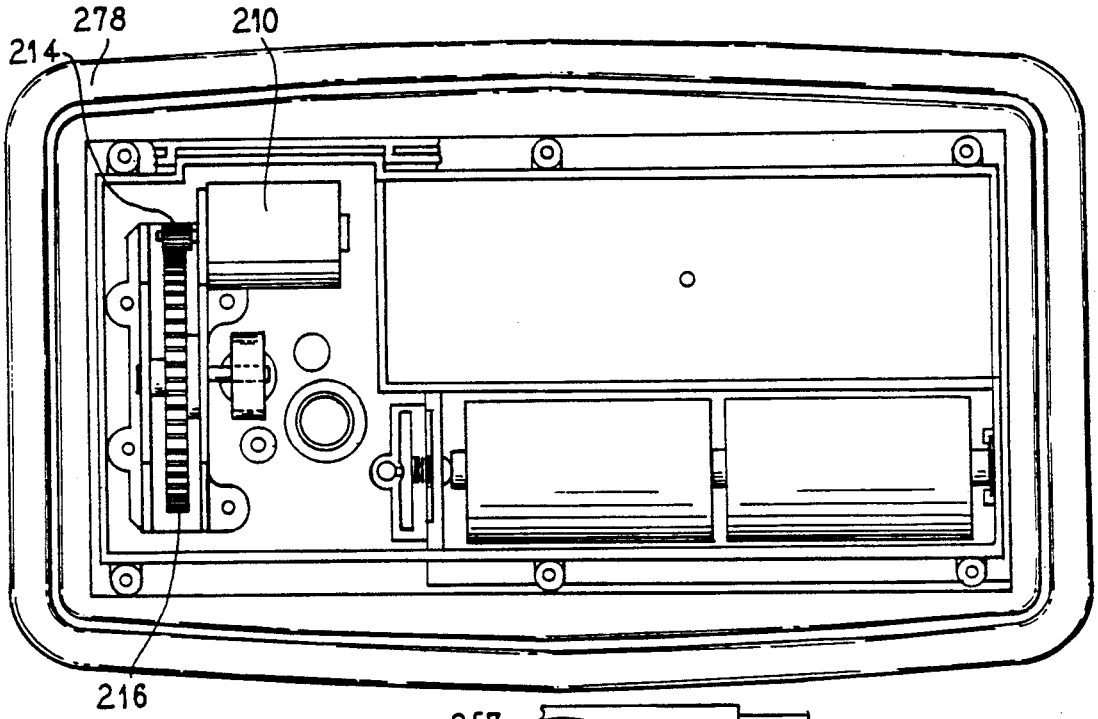
FIG. 14 is a top sectional view of the housing of the FIG. 11 embodiment.
Figure 15:
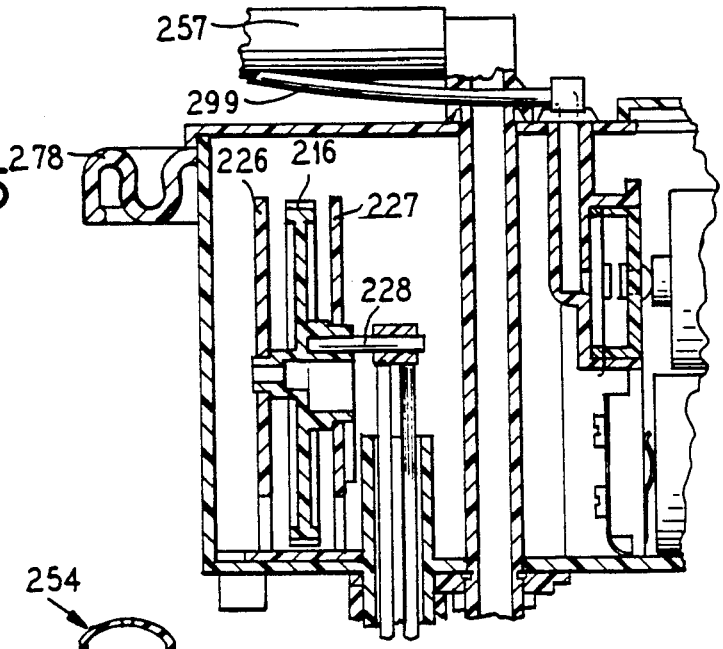
FIG. 15 is a partial sectional view of the FIG. 11 embodiment.
Figure 16:
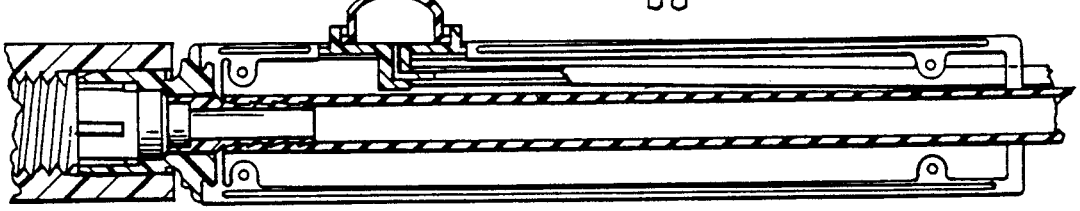
FIG. 16 is a sectional view, partially broken away, of a roller handle.

As can be seen in FIG. 12, when the housing 262 is secured to the reservoir 260, the top wall 276 of the housing 262 is roughly coplanar with the top edge 268 of the reservoir 260, and the side wall(s) 274 and bottom wall 272 of the housing 262 extend into the interior 282 of the reservoir.

This configuration not only provides a more compact unit, but also enhances protection of the pump and motor assembly by encasing all moving parts in a double sidewall.

Figure 17:
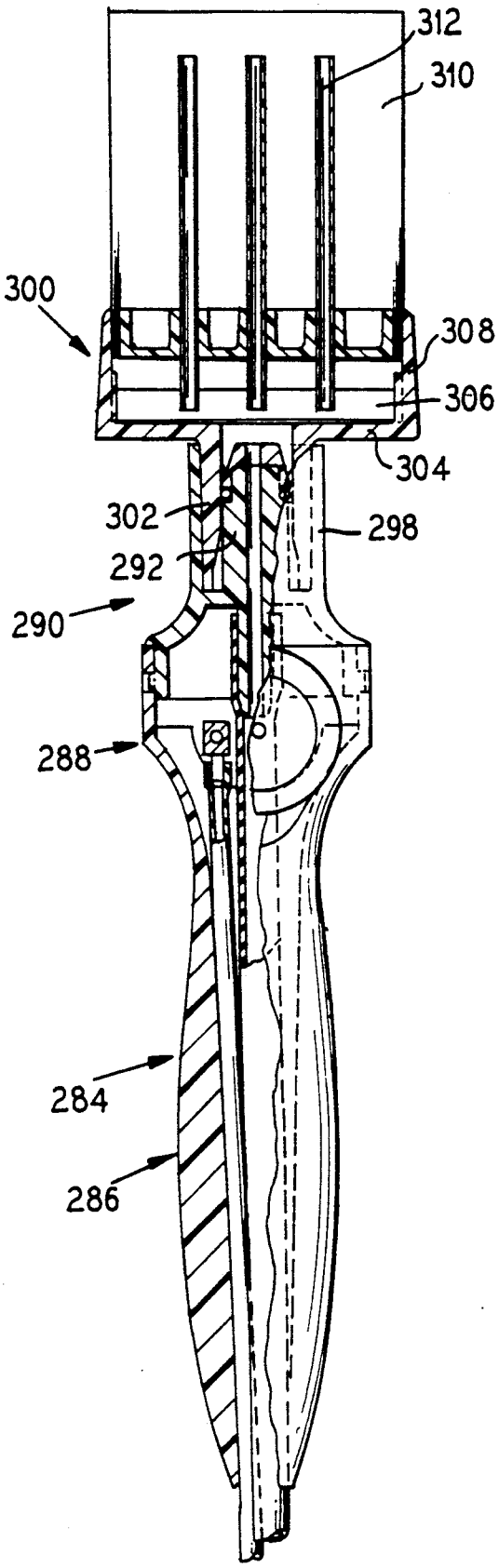
FIGS. 17 and 18 are sectional views of brush applicators having interchangeable bristle units.
Figure 18:
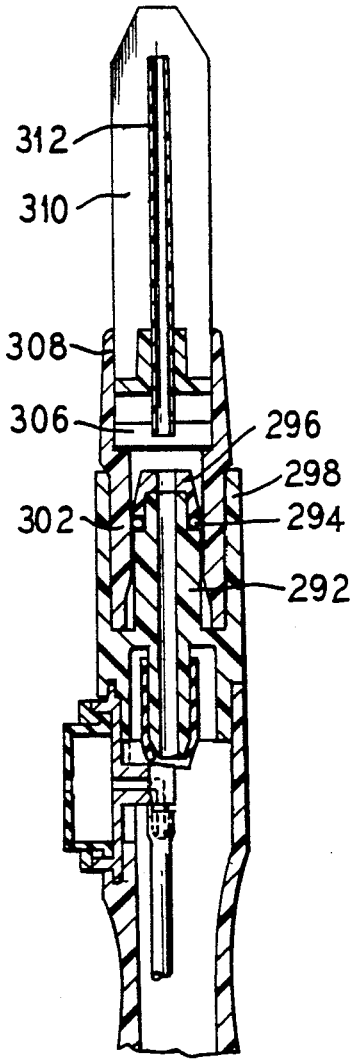

As seen in FIGS. 17 and 18, the present invention can be provided with an applicator having interchangeable bristle units. A handle unit 284 includes a handle section 286, an actuator section 288, and a connector section 290. The connector section 290 includes a paint-conducting plug 292 having an 0-ring 294 secured by a conical cap 296. A protective sleeve 298 surrounds the plug 292. A bristle unit 300 includes a paintconducting socket 302 secured to an end plate 304, which forms a header reservoir 306 by closing off one end of a ferrule 308. Bristles 310 extend from another end of the ferrule 308, and paint is fed from the header reservoir 306 to the bristles 310 by a plurality of spreaders 312. The socket 302 of the bristle unit 300 is adapted to receive the plug 292 of the handle unit 284. In illustrated embodiment, the plug 292 and socket 302 are held together due to the sealing engagement of their respective contact surfaces.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A self-contained, power painting system comprising:

a paint reservoir including a bottom, at least one retaining wall extending upwardly rom said bottom, and a top edge distal from said bottom;

a paint supply means comprising a power source, an electric motor energized by said power source, and a pump driven by said motor for pumping paint from said reservoir;

housing means for enclosing said paint supply means, said housing means including a top wall, at least one side wall and a bottom wall;

an applicator means for receiving paint pumped from said reservoir and for applying paint to a surface;

delivery conduit means for carrying said paint from said paint supply means to said applicator means;

said paint reservoir and paint supply means being operatively joinable as a unit so that said bottom wall and a major portion of said at least one side wall of said housing extend downwardly into said reservoir below said top edge thereof; and carrying means secured to said unit for permitting passive attachment of said unit to a user of said painting system, and for causing said unit to accompany the suer during operation of the system;

wherein said power source comprises at least one battery;

wherein said paint supply means further includes a manually operable electrical switch means for selectively energizing said motor;

wherein said switch means comprises a manually operable vented bulb at said applicator means, said bulb having at least a portion thereof formed from a flexible material and connected by a second, air filled conduit to said paint supply means, and an electrical switch at said paint supply means having a movable contact engageable by a flexible diaphragm, which diaphragm communicates at one side with said second conduit, such that manual depression of said flexible portion of said bulb results in deflection of said movable contact to close a circuit normally opened by said switch.

2. A painting system according to claim 1, wherein said pump comprises a peristaltic pump.

3. A painting system according to claim 1, wherein said paint supply means is carried in a removable cover for said paint reservoir.

4. A painting system according to claim 1, wherein said delivery conduit comprises a flexible tube.

5. A painting system according to claim 1, wherein said paint reservoir comprises a walled container having a large top opening closeable by means of a removable cover.

6. A painting system according to claim 1, wherein said pump is a piston pump.

7. A painting system according to claim 6, wherein said piston pump comprises the following:

a gear wheel driven by a shaft extending from said motor, said gear wheel having a rotational axis along which extends a cylindrical hub;

an eccentric pin extending from a face of said gear wheel;

a piston shaft having a first end at which is disposed a horizontally extending slot, said horizontally extending slot receiving said eccentric pin;

a piston mounted on a second end of said piston shaft; and bearing means for mounting said gear wheel, said bearing means including first and second bearing flanges, each of which rotatably receives a respective end of said cylindrical hub.

8. A painting system according to claim 1, wherein said applicator means comprises a bristled brush assembly.

9. A painting system according to claim 8, wherein said bristled brush assembly comprises the following:

a handle;

a plurality of bristle units; and connector means for interchangeably securing any one of said bristle units to said handle.

10. A painting system according to claim 9, wherein said connector means comprises the following:

a paint-conducting plug secured to and extending from an end of said handle, said plug and said handle sharing a common longitudinal axis;

wherein each of said bristle units includes a plurality of bristles surrounded by, and extending from a first end of a ferrule, said ferrule being closed at a second end thereof by an end plate, with a paint conducting socket extending from said end plate and adapted to receive said paint-conducting plug; and seal means for maintaining a fluid-tight seal between said plug and said socket when one of said bristle units is operatively coupled to said handle.

11. A painting system according to claim 10, wherein said plug and said socket are maintained in an operatively coupled position by means of a sealing engagement between respective contact surfaces thereof.

12. A painting system according to claim 1, wherein said paint supply means further comprises the following:

housing means for enclosing said motor, said pump, and said electrical switch, said housing including a top wall, at least one side wall, and a bottom wall; and wherein said electrical switch is secured to, and extends downwardly from, said top wall of said housing means.

13. A self-contained power painting system comprising:

a paint reservoir comprising a walled container having a large top opening at a top edge thereof closeable by means of a removable cover;

a pain supply means comprising a battery power supply, an electric motor energized by said battery power supply through an electric circuit, a pump driven by said motor and electrical switch means in said circuit to control energization of said motor;

said removable cover comprising housing means for enclosing said paint supply means, said housing means including a top wall, at least one side wall and a bottom wall;

said paint reservoir and paint supply means being operatively joinable as a unit so that said bottom wall and a major portion of at least one side wall of said housing extend downwardly into said reservoir below said top edge;

an applicator means for receiving paint pumped from said reservoir and for applying paint to a surface;

flexible tube delivery conduit means for carrying said paint from said paint supply means to said applicator means;

activation means for said electrical switch means comprising a manually operable vented bulb at said applicator means, said bulb having at least a portion thereof formed from a flexible material and connected by a second, air filled conduit to said paint supply means, said electrical switch means at said paint supply means having a movable contact engageable by a flexible diaphragm, which diaphragm communicates at one side with said second conduit, such that manual depression of said flexible portion of said bulb results in deflection of said movable contact to close a circuit normally opened by said switch; and carrying means secured to said unit for permitting passive attachment of said unit to a user of said painting system, and for causing said unit to accompany the suer during operation of the system.

14. A self-contained, power painting system comprising the following:

a pain reservoir including a bottom, at least one retaining wall extending upwardly from said bottom, and a top edge distal from said bottom;

a paint supply means comprising at least one battery, a motor energized by said battery, a manually operable electrical switch means for selectively energizing said motor, said switch means comprising a manually operable vented bulb at an applicator means, said bulb connected by a second, air filled conduit to said paint supply means, and an electrical switch at said paint supply means having a movable contact engageable by a flexible diaphragm, which diaphragm communicates at one side with said second conduit, such that manual depression of said bulb results in deflection of said movable contact to close a circuit normally opened by said switch, and a pump means driven by said motor for pumping paint from said reservoir;

housing means for enclosing said paint supply means, said housing means including a top wall, at least one side wall, and a bottom wall;

applicator means for receiving paint from said reservoir and for applying paint to a surface;

delivery conduit means for carrying said paint from said paint supply means to said applicator means;

seal means for operatively joining said housing means to said reservoir so that said bottom wall and a major portion of said at least one side wall of said housing extend downwardly into said reservoir.

15. A painting system according to claim 14, wherein said at least one battery comprises a plurality of batteries.

16. A painting system according to claim 14, wherein said pump means comprises the following:

a gear wheel driven by a shaft extending from said motor, said gear wheel having a rotational axis along which extends a cylindrical hub;

an eccentric pin extending from a face of said gear wheel;

a piston shaft having a first end at which is disposed a horizontally extending slot, said horizontally extending slot receiving said eccentric pin;

a piston mounted on a second end of said piston shaft; and bearing means for mounting said gear wheel, said bearing means including first and second bearing flanges, each of which rotatably receives a respective end of said cylindrical hub.

17. A painting system according to claim 14, wherein said applicator means comprises a roller assembly.

18. A painting system according to claim 14, wherein said applicator means includes a roller assembly having a handle, and said bulb of said switch means is located on said handle.

19. A painting system according to claim 14, wherein said top edge of said reservoir extends along a periphery of said at least one retaining wall, and said seal means operatively joins said housing and said reservoir further so that said top wall of said housing is substantially coplanar with said top edge of said reservoir.

20. A painting system according to claim 14, further wherein:

said top edge of said reservoir defines a large top opening of said reservoir;

said housing comprises a removable cover means for covering said top opening; and said seal means provides a fluid-tight seal between said cover means and said top opening.

* * * * *